US011598576B2

(12) United States Patent
Li

(10) Patent No.: US 11,598,576 B2
(45) Date of Patent: Mar. 7, 2023

(54) REFRIGERATOR APPLIANCE WITH MIXING DISPENSER

(71) Applicant: Haier US Appliance Solutions, Inc., Wilmington, DE (US)

(72) Inventor: Jianwu Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 28 days.

(21) Appl. No.: 17/091,490

(22) Filed: Nov. 6, 2020

(65) Prior Publication Data

US 2022/0146187 A1 May 12, 2022

(51) Int. Cl.

| | |
|---|---|
| ***B67D 1/00*** | (2006.01) |
| ***F25D 23/12*** | (2006.01) |
| ***B67D 1/08*** | (2006.01) |

(52) U.S. Cl.

CPC ..... *F25D 23/126* (2013.01); *B67D 1/0884* (2013.01); *B67D 2001/0094* (2013.01); *B67D 2210/00036* (2013.01); *F25D 2323/122* (2013.01)

(58) Field of Classification Search

CPC ..... F25D 2323/122; F25D 23/126; F25D 23/028; F25D 23/04; B67D 1/0884; B67D 1/0867; B67D 1/0892; B67D 2001/0094; B67D 2210/00036; B67D 1/0865

USPC ..... 62/389, 390, 396; 222/129.1, 144.5, 222/146.1, 146.6

See application file for complete search history.

(56) References Cited

U.S. PATENT DOCUMENTS

| | | | | |
|---|---|---|---|---|
| 3,269,422 | A * | 8/1966 | Matthews | F16L 9/18 165/172 |
| 4,276,999 | A * | 7/1981 | Reichenberger | B67D 1/0041 222/17 |
| 4,792,059 | A * | 12/1988 | Kerner | B67D 3/00 222/144.5 |
| 5,000,351 | A * | 3/1991 | Rudick | B67D 1/1293 222/105 |
| 5,094,088 | A * | 3/1992 | Davis | B67D 1/0867 62/436 |
| 5,694,787 | A * | 12/1997 | Cleleand | B67D 1/16 62/396 |
| 5,725,028 | A * | 3/1998 | Cleland | F16L 9/20 138/137 |
| 6,598,417 | B1 * | 7/2003 | Wilkes | F25D 17/02 62/390 |

(Continued)

FOREIGN PATENT DOCUMENTS

KR 20050119438 A 12/2005

*Primary Examiner* — Charles P. Cheyney
(74) *Attorney, Agent, or Firm* — Dority & Manning, P.A.

(57) ABSTRACT

A refrigerator appliance includes a cabinet with a food storage chamber defined in the cabinet. The refrigerator appliance also includes a door rotatably mounted to the cabinet. The door includes an outer surface and an opposing inner surface, wherein the inner surface faces towards the food storage chamber when the door is in the closed position and the outer surface faces away from the food storage chamber when the door is in the closed position. The refrigerator appliance also includes a dispenser assembly with a plurality of liquid sources fluidly coupled to the dispenser assembly and a multi-fluid tube. Each liquid source of the plurality of liquid sources is fluidly coupled to the dispenser assembly through the multi-fluid tube.

16 Claims, 11 Drawing Sheets

(56) References Cited

U.S. PATENT DOCUMENTS

| | | | | |
|---|---|---|---|---|
| 7,207,189 | B2 * | 4/2007 | An | F25D 23/028 165/63 |
| 7,516,623 | B2 * | 4/2009 | Hall, Sr. | B67D 1/0867 62/297 |
| 8,083,104 | B2 * | 12/2011 | Roetker | B67D 1/0884 62/390 |
| 8,499,978 | B2 | 8/2013 | Borges | |
| 9,139,415 | B2 * | 9/2015 | Hall | F25D 23/028 |
| 10,352,614 | B2 * | 7/2019 | Platts | F25D 25/025 |
| 10,399,842 | B2 * | 9/2019 | Henriquez | B67D 1/0086 |
| 10,557,469 | B2 * | 2/2020 | Han | F04D 1/00 |
| 2012/0267070 | A1 * | 10/2012 | Mack | F28D 7/0041 165/104.11 |
| 2014/0116083 | A1 * | 5/2014 | Chung | F25C 1/00 62/340 |
| 2015/0308755 | A1 * | 10/2015 | Rasmussen | F28F 1/10 165/135 |
| 2015/0354886 | A1 * | 12/2015 | Sinko | F25D 31/006 62/390 |
| 2019/0219323 | A1 * | 7/2019 | Dhande | F25D 29/005 |

* cited by examiner

REFRIGERATOR APPLIANCE WITH MIXING DISPENSER

FIELD OF THE INVENTION

The present subject matter relates generally to refrigerator appliances, and more particularly to dispenser systems for a refrigerator appliance.

BACKGROUND OF THE INVENTION

Refrigerator appliances generally include a cabinet that defines a chilled chamber. A wide variety of food items may be stored within the chilled chamber. The low temperature of the chilled chamber relative to ambient atmosphere assists with increasing a shelf life of the food items stored within the chilled chamber.

Refrigerator appliances may also be equipped with a dispensing system. Such dispensing systems typically provide chilled water and/or ice from inside of the refrigerator appliance to a dispensing outlet accessible from outside of the refrigerator appliance. Such dispensing outlets are typically provided in an external surface of a door of the refrigerator appliance, in order to provide access to the water and/or ice from inside of the refrigerator appliance without requiring opening the door. However, such systems are limited in the quantity and variety of items or contents from within the refrigerator appliance that can be delivered to the dispensing outlet.

Accordingly, a refrigerator with an improved dispensing system is desired. For example, a refrigerator appliance with features for dispensing multiple fluids would be useful.

BRIEF DESCRIPTION OF THE INVENTION

Aspects and advantages of the invention will be set forth in part in the following description, or may be apparent from the description, or may be learned through practice of the invention.

In one exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet with a food storage chamber defined in the cabinet. The food storage chamber extends between a front portion and a back portion along the transverse direction. The front portion of the food storage chamber defines an opening for receipt of food items. The refrigerator appliance also includes a door rotatably mounted to the cabinet at the front portion of the food storage chamber. The door is movable between a closed position and an open position to selectively sealingly enclose the food storage chamber. The door includes an outer surface and an opposing inner surface, wherein the inner surface faces towards the food storage chamber when the door is in the closed position and the outer surface faces away from the food storage chamber when the door is in the closed position. The refrigerator appliance also includes a dispenser assembly with a plurality of liquid sources fluidly coupled to the dispenser assembly and a multi-fluid tube. Each liquid source of the plurality of liquid sources is fluidly coupled to the dispenser assembly through the multi-fluid tube.

In another exemplary embodiment, a refrigerator appliance is provided. The refrigerator appliance includes a cabinet with a food storage chamber defined in the cabinet. The food storage chamber defines an opening for receipt of food items. The refrigerator appliance also includes a door rotatably mounted to the cabinet at the opening of the food storage chamber. The door is movable between a closed position and an open position to selectively sealingly enclose the food storage chamber. The door includes an outer surface and an opposing inner surface, wherein the inner surface faces towards the food storage chamber when the door is in the closed position and the outer surface faces away from the food storage chamber when the door is in the closed position. The refrigerator appliance also includes a dispenser assembly with a plurality of liquid sources fluidly coupled to the dispenser assembly and a multi-fluid tube. Each liquid source of the plurality of liquid sources is fluidly coupled to the dispenser assembly through the multi-fluid tube.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
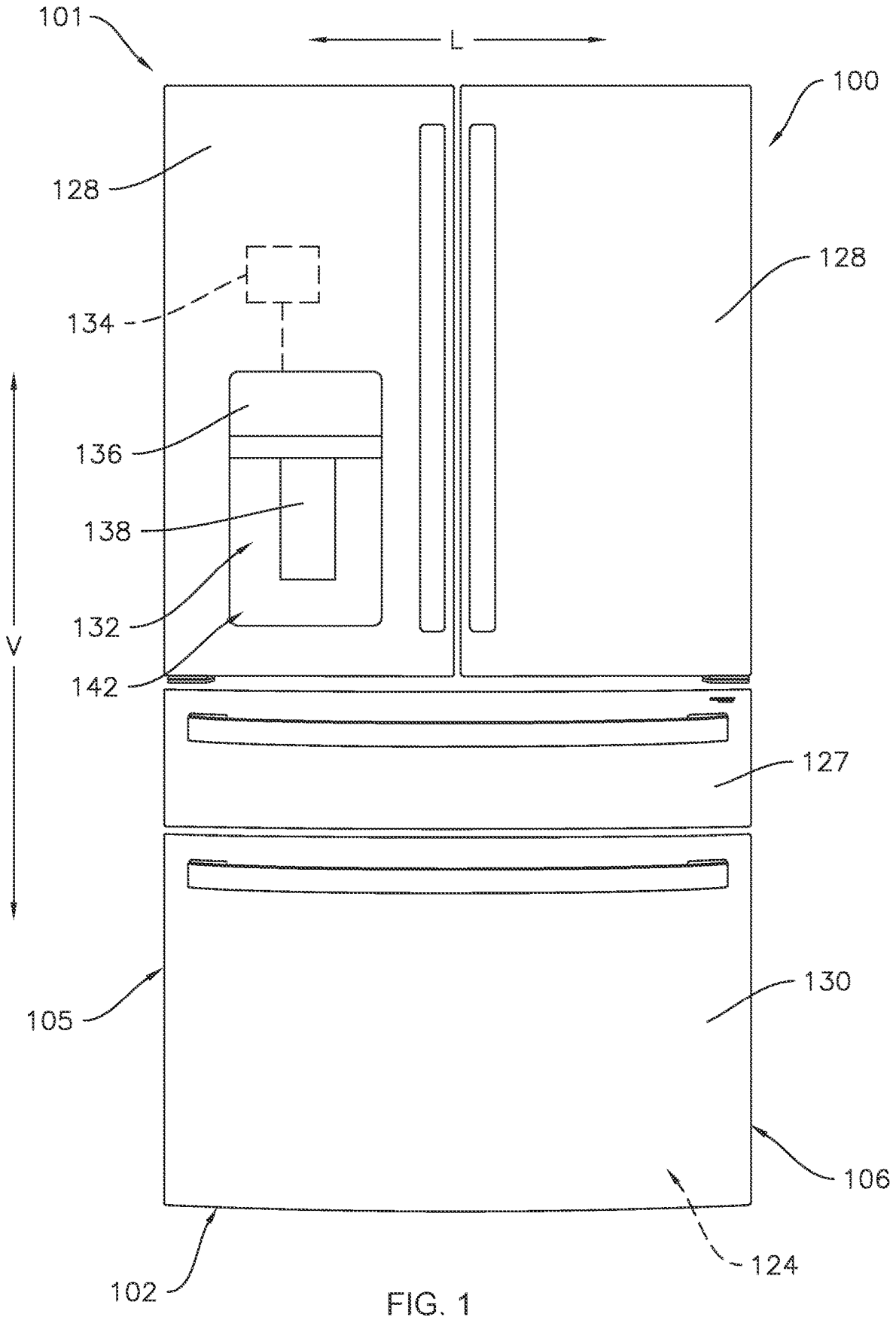
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
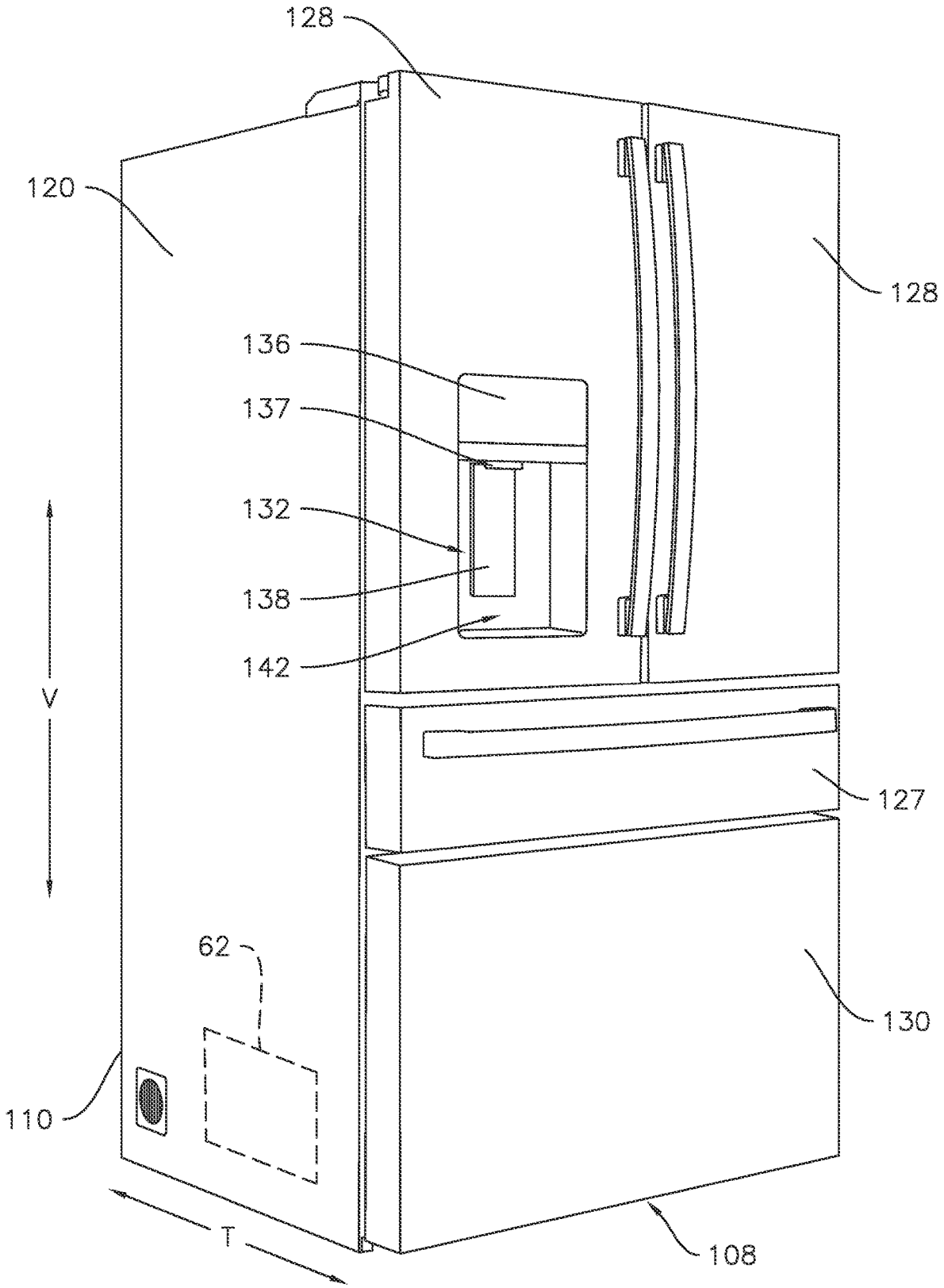
FIG. 2 provides a perspective view of the refrigerator appliance of FIG. 1.
Figure 3:
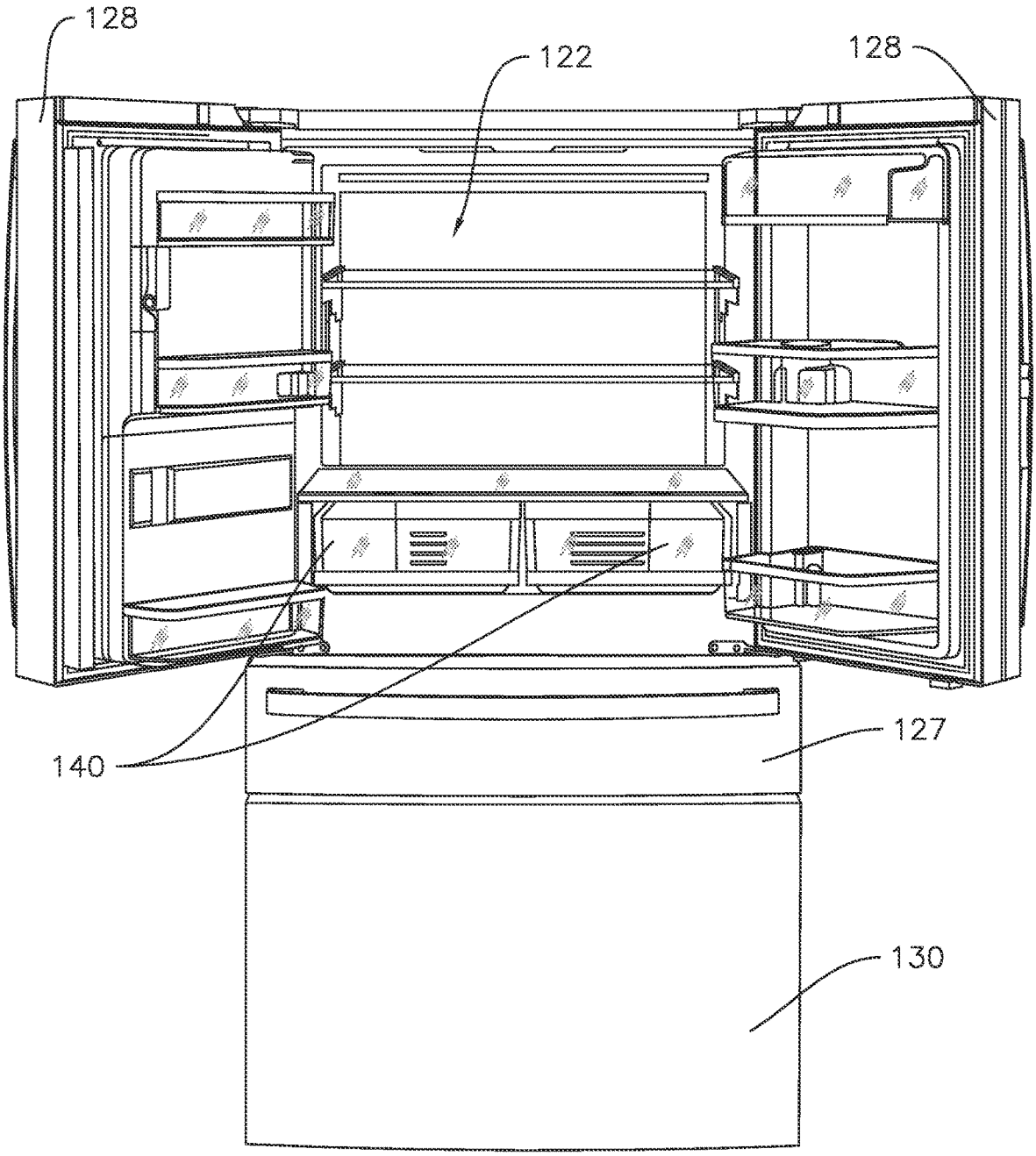
FIG. 3 provides a front view of the refrigerator appliance of FIG. 1 with doors in an open position.

FIG. 1 is a front view of an exemplary embodiment of a refrigerator appliance 100. FIG. 2 is a perspective view of the refrigerator appliance 100. FIG. 3 is a front view of the refrigerator appliance 100 with fresh food doors 128 thereof in an open position. Refrigerator appliance 100 extends between a top 101 and a bottom 102 along a vertical direction V. Refrigerator appliance 100 also extends between a first side 105 and a second side 106 along a lateral direction L which is perpendicular to the vertical direction V. As shown in FIG. 2, a transverse direction T may additionally be defined perpendicular to the vertical and lateral directions V, L. Refrigerator appliance 100 extends along the transverse direction T between a front portion 108 and a back portion 110.

Figure 4:
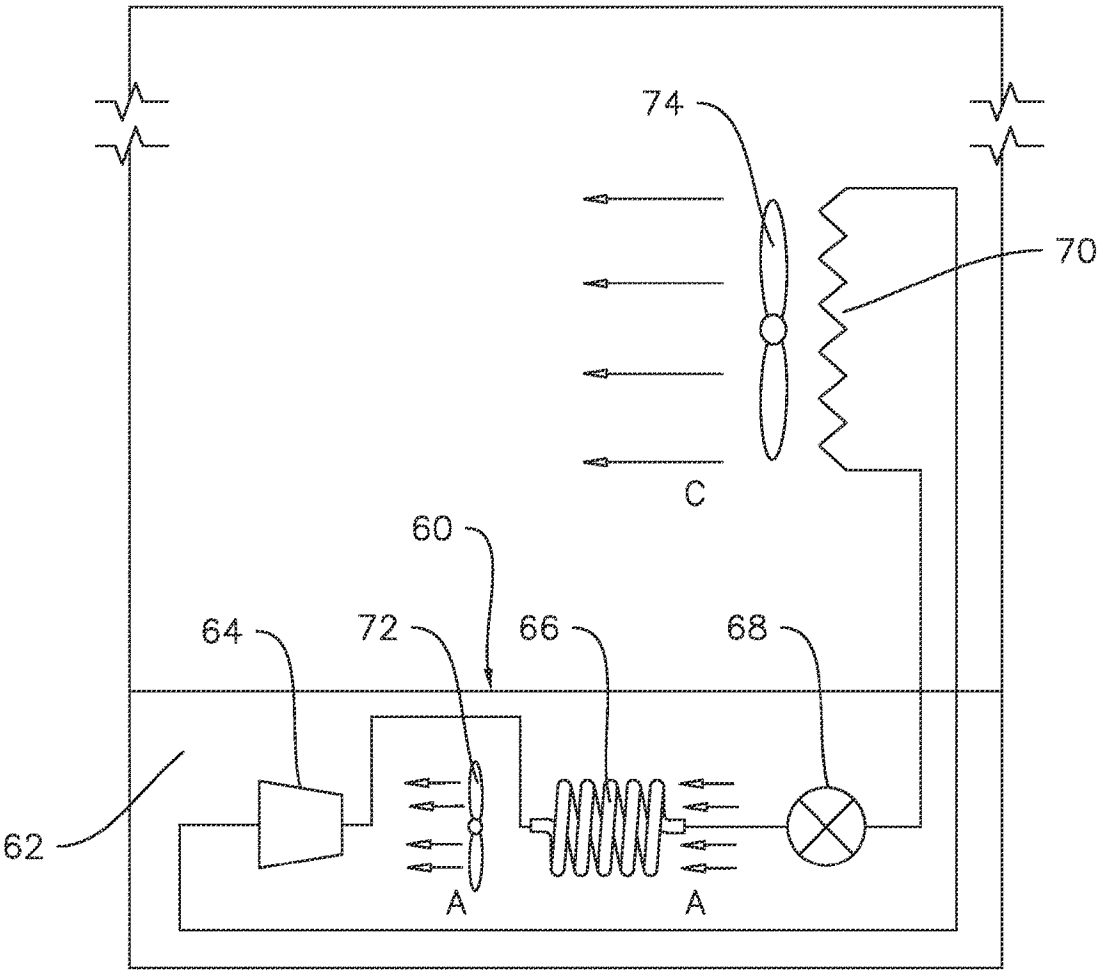
FIG. 4 provides a schematic illustration of an example sealed cooling system as may be used with a refrigerator appliance in one or more exemplary embodiments of the present subject matter.

Refrigerator appliance 100 includes a cabinet or housing 120 defining one or more chilled chambers, such as an upper fresh food chamber 122 (FIG. 3) and a lower freezer chamber or frozen food storage chamber 124 (FIG. 1) arranged below the fresh food chamber 122 along the vertical direction V. As used herein, the chambers may be "chilled" in that the chambers are operable at temperatures below room temperature, e.g., less than about seventy-five degrees Fahrenheit (75° F.). An auxiliary food storage chamber may be positioned between the fresh food storage chamber 122 and the frozen food storage chamber 124, e.g., along the vertical direction V. Because the frozen food storage chamber 124 is positioned below the fresh food storage chamber 122, refrigerator appliance 100 is generally referred to as a bottom mount refrigerator. In the exemplary embodiment, housing 120 also defines a mechanical compartment 62 (FIG. 2) for receipt of a sealed cooling system 60 (FIG. 4). Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the technology in any aspect.

Refrigerator doors 128 are each rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably mounted within freezer chamber 124. An auxiliary door 127 is coupled to an auxiliary drawer (not shown) which is slidably mounted within an auxiliary chamber (not shown). As may be seen in FIG. 3, a plurality of food storage compartments 140 are disposed within the fresh food storage chamber 122.

Operation of the refrigerator appliance 100 can be regulated by a controller 134 that is operatively coupled to a user interface panel 136. Interface panel 136 provides selections for user manipulation of the operation of refrigerator appliance 100 to modify environmental conditions therein, such as temperature selections, etc. In some embodiments, user interface panel 136 may be proximate a dispenser assembly 132. In response to user manipulation of the user interface panel 136, the controller 134 operates various components of the refrigerator appliance 100. Operation of the refrigerator appliance 100 can be regulated by the controller 134, e.g., controller 134 may regulate operation of various components of the refrigerator appliance 100 in response to programming and/or user manipulation of the user interface panel 136.

As best seen in FIGS. 1 and 2, dispensing assembly 132 includes a dispenser positioned on or mounted to an exterior portion of refrigerator appliance 100, e.g., on an outer surface of one of refrigerator doors 128. The dispenser includes a discharging outlet 137 (FIG. 2) for accessing ice and liquid water. An actuating mechanism 138, shown as a paddle, is mounted below discharging outlet 137 for operating the dispenser. In alternative exemplary embodiments, any suitable actuating mechanism may be used to operate the dispenser. For example, the dispensing assembly 132 can include a sensor (such as an ultrasonic sensor) or a button rather than the paddle 138. The user interface panel 136 may provide for controlling the mode of operation of the dispensing assembly 132. For example, user interface panel 136 includes a plurality of user inputs (not labeled), such as a water dispensing button and an ice-dispensing button, for selecting a desired mode of operation such as crushed or non-crushed ice. Additionally, the user inputs may include inputs for selecting one of a plurality of different liquids, such as juice, carbonated water or soda, tea, etc., and/or inputs for selecting a temperature for water to be dispensed, such as chilled, room temperature, or warm, among other possible options.

Discharging outlet 137 and actuating mechanism 138 are an external part of dispenser 134 and are mounted in a dispenser recess 142. Dispenser recess 142 is positioned at a predetermined elevation convenient for a user to access ice or liquids and enabling the user to access the dispensed ice and/or liquids without the need to bend-over and without the need to open refrigerator doors 128. In the exemplary embodiment, dispenser recess 142 is positioned at a level that approximates the chest level of an adult user. According to an exemplary embodiment, the dispensing assembly 132 may receive ice from an icemaker disposed in a sub-compartment of the fresh food chamber 122.

The controller 134 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. It should be noted that controllers 134 as disclosed herein are capable of and may be operable to perform any methods and associated method steps as may be disclosed herein.

The controller 134 may be positioned in a variety of locations throughout refrigerator appliance 100. In the illustrated embodiment, the controller 134 may be located within the door 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. For example, the user interface 136 may include a touchscreen providing both input and display functionality. The user interface 136 may be in communication with the controller via one or more signal lines or shared communication busses.

Using the teachings disclosed herein, one of skill in the art will understand that the present subject matter can be used with other types of refrigerators such as a refrigerator/freezer combination, side-by-side, bottom mount, compact, and any other style or model of refrigerator appliance. Accordingly, other configurations of refrigerator appliance 100 could be provided, it being understood that the configurations shown in the accompanying figures and the description set forth herein are by way of example for illustrative purposes only.

FIG. 4 provides a schematic view of the refrigerator appliance 100, in particular the sealed cooling system 60 thereof. As illustrated in FIG. 4, refrigerator appliance 100 includes a machinery compartment 62 that at least partially contains components for executing a known vapor compression cycle for cooling air. The components include a compressor 64, a heat exchanger or condenser 66, an expansion device 68, and an evaporator 70 connected in series and charged with a refrigerant. Evaporator 70 is also a type of heat exchanger which transfers heat from air passing over the evaporator to a refrigerant flowing through evaporator 70 thereby causing the refrigerant to vaporize. As such, cooled air C is produced and configured to refrigerate chambers 122, 123, 124, and 300 of refrigerator appliance 100. The cooled air C may be directed to the food storage chambers 122, 123, 124, and 300 by a fan 74.

From evaporator 70, vaporized refrigerant flows to compressor 64, which operates to increase the pressure of the refrigerant. This compression of the refrigerant raises its temperature, which is lowered by passing the gaseous refrigerant through condenser 66 where heat exchange with ambient air takes place so as to cool the refrigerant. A fan 72 is used to pull air across condenser 66, as illustrated by arrows A, so as to provide forced convection for a more rapid and efficient heat exchange between the refrigerant and the ambient air.

Expansion device 68 further reduces the pressure of refrigerant leaving condenser 66 before being fed as a liquid to evaporator 70. Collectively, the vapor compression cycle components in a refrigeration circuit, associated fans, and associated compartments are sometimes referred to as a sealed refrigeration system operable to force cold air through refrigeration chambers 122, 123, 124, and 300. The refrigeration system 60 depicted in FIG. 4 is provided by way of example only. It is within the scope of the present invention for other configurations of the refrigeration system to be used as well. For example, fan 74 may be repositioned so as to push air across evaporator 70, dual evaporators may be used with one or more fans, and numerous other configurations may be applied as well.

Referring generally to FIGS. 5 through 11, the refrigerator appliance 100 may include a multi-fluid dispensing system. In various embodiments, the multiple fluids may be entirely distinct liquids, e.g., one or more juices, one or more flavored and/or carbonated waters, tea, e.g., iced tea, soda, etc., or may be the same liquid, such as water, at different temperatures, or may include any combination thereof, such as chilled water, room temperature water, and one or more juices. Additionally, the multi-fluid dispensing system may provide mixtures of such liquids, e.g., different flavored juices by mixing more than one juice, different temperature water by mixing water from more than one source with each source providing a distinct temperature water, etc. The multi-fluid dispensing system may advantageously include a single fluid conduit, e.g., a multi-fluid tube 200, as will be described in more detail below, which provides a selective flow of one or more liquids, including mixtures of the liquids, from multiple distinct sources to the dispensing assembly 132. In particular, only the single tube may pass through a hinge 129 between the cabinet 120 and the door 128 in order to provide the multiple fluids to the dispensing assembly 132 in the door 128. For example, other conduits for other purposes may be included, but only one conduit, e.g., only the multi-fluid tube 200, is coupled to the dispensing assembly 132 and provides a flow of liquids to the dispensing assembly 132 and/or the discharging outlet 137 thereof. Note that in embodiments where the dispensing assembly 132 also includes features for dispensing ice, ice would be recognized by those of ordinary skill in the art as a solid, not a fluid. This is true even in cases where the ice is partially melted, because the ice is at least predominantly (e.g., 90% or more by volume) in solid form, those of ordinary skill in the art would not consider the ice dispensing features as providing "a flow of liquid to the dispensing assembly 132." Therefore, even in embodiments where the dispensing assembly 132 also includes features for dispensing ice, those of ordinary skill in the art would understand that only the multi-fluid tube 200 provides a flow of liquids to the dispensing assembly 132 and/or the discharging outlet 137 thereof.

Additionally, in various embodiments, certain components of the multi-fluid dispensing system may be located in the cabinet 120 or in the door 128. For example, as will be described in more detail below, valves 228, 230, and 232 of the multi-fluid dispensing system may be located in the cabinet 120, thereby reducing the weight of the door 128 and simplifying the door design, or may be located in the door 128 in order to provide increased storage capacity within the cabinet 120.

Figure 5:
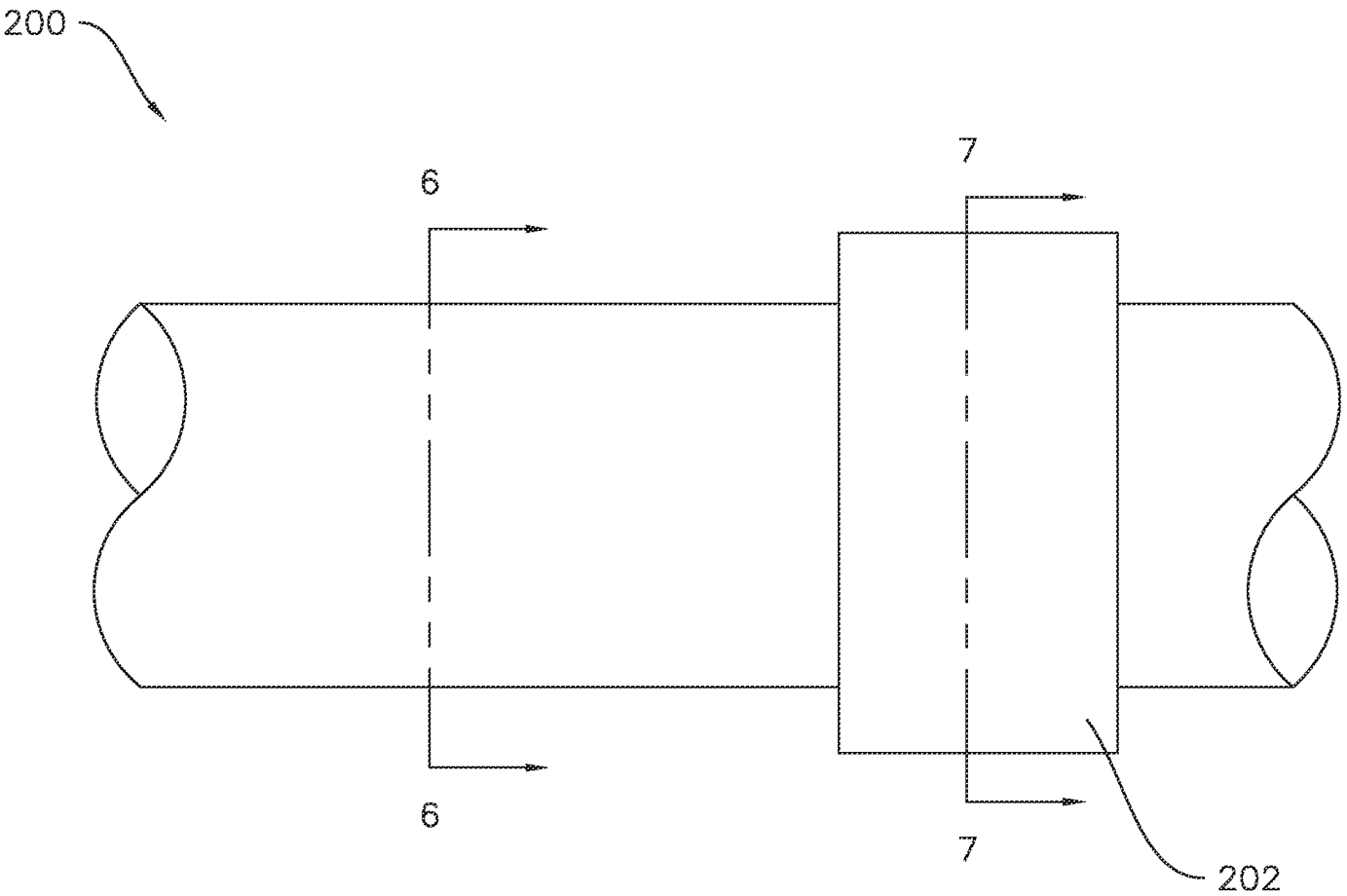
FIG. 5 provides an illustration of an exemplary multi-fluid tube according to one or more embodiments of the present invention.
Figure 6:
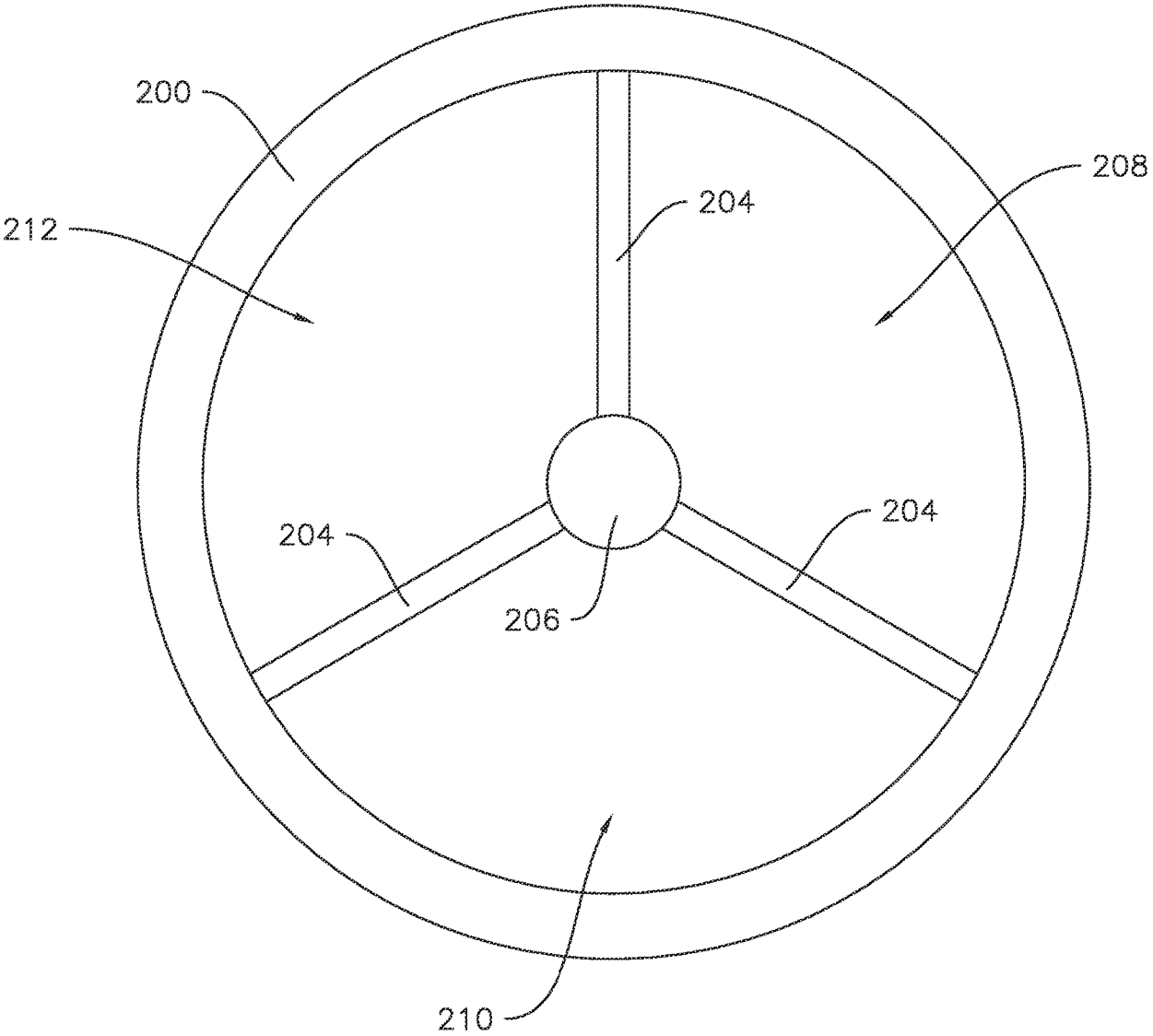
FIG. 6 provides a section view of the multi-fluid tube of FIG. 5 taken along line 6-6 in FIG. 5.
Figure 7:
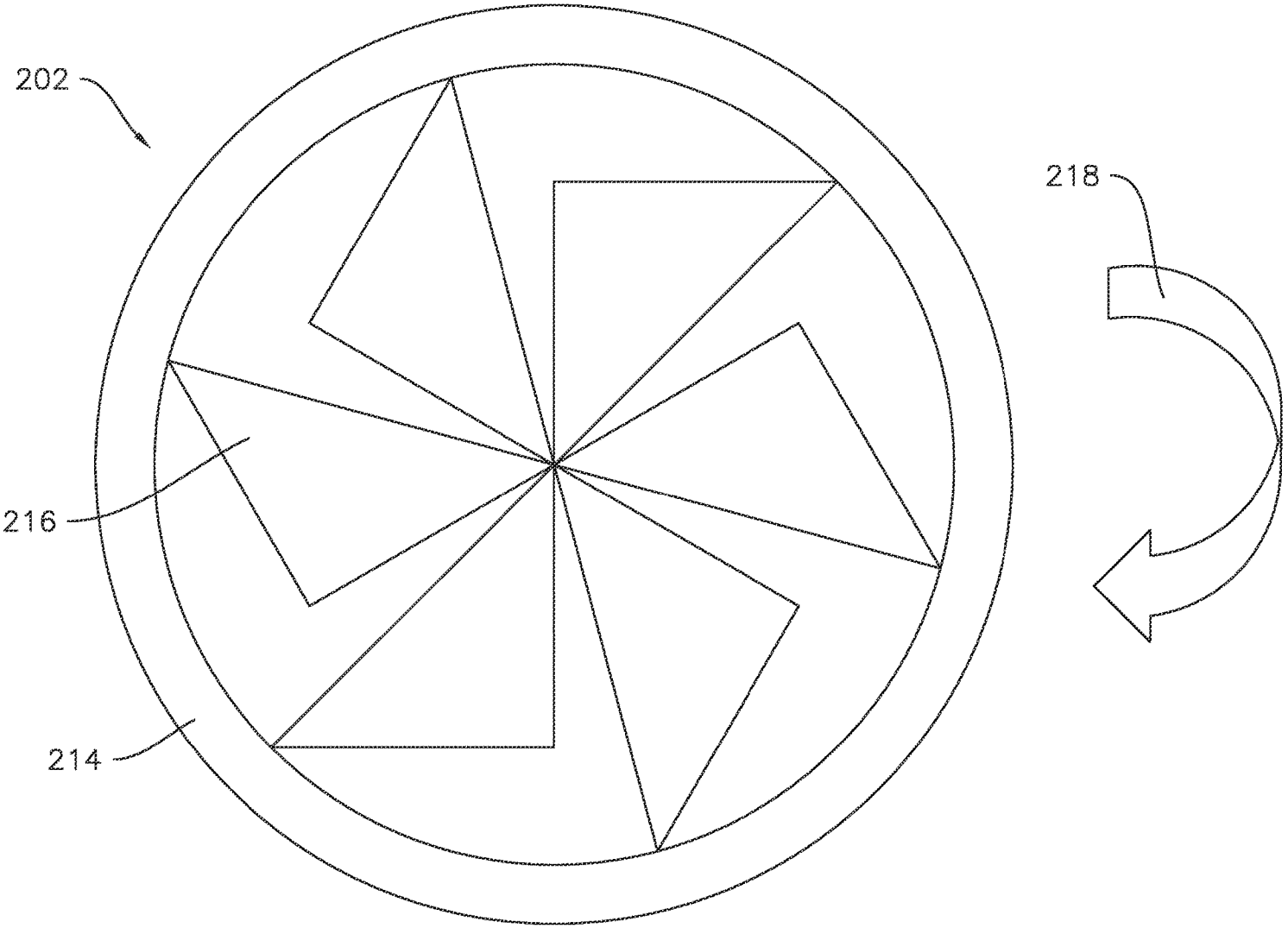
FIG. 7 provides a section view of the multi-fluid tube of FIG. 5 taken along line 7-7 in FIG. 5.

An exemplary multi-fluid tube 200 according to one or more embodiments of the present subject matter is illustrated in FIGS. 5-7. In some embodiments, the multi-fluid tube 200 may include a mixing wheel 202, as illustrated, while other embodiments may omit the mixing wheel 202. FIG. 5 provides a side view of an exemplary mixing tube 200 according to one or more exemplary embodiments of the present subject matter. As illustrated in FIG. 5, the flow of one or more fluids through the multi-fluid tube 200 may be from left to right on the page, such that the mixing wheel 202, in embodiments which include the mixing wheel 202, is located at or proximate to a downstream end of the multi-fluid tube 200.

Referring now to FIG. 6, the multi-fluid tube 200 may include a plurality of distinct chambers, e.g., three chambers 208, 210, and 212, as illustrated in FIG. 6, which are fluidly isolated from each other over at least a portion of the longitudinal extent of the multi-fluid tube 200, such as at least upstream of the mixing wheel 202 in embodiments where the mixing wheel 202 is provided. In additional embodiments, the multi-fluid tube 200 may include two chambers or more than three chambers. The chambers may be defined by and mutually separated by a plurality of partitions 204. For example, as illustrated in FIG. 6, the multi-fluid tube 200 may include three partitions 204 which separate and define, e.g., define boundaries of, the three chambers 208, 210, and 212. In particular, the plurality of distinct chambers may include a first chamber 208 coupled to a first liquid source which provides a first liquid to the first chamber 208, a second chamber 210 coupled to a second liquid source which provides a second liquid that is distinct (e.g., at least with respect to the type and/or quality, e.g., temperature, of the liquid in the respective source) from the first liquid, and a third chamber 212 coupled to a third liquid source that provides a third liquid which is distinct from each of the first liquid and the second liquid.

In some embodiments, a mixing wheel 202 may be provided, such as the example mixing wheel 202 illustrated in FIG. 7. As will be described in more detail below, a plurality of valves may be provided between each liquid source and the multi-fluid tube 200, such that by opening two or more of the valves, two or more liquids may be provided to the dispensing assembly 132 via the multi-fluid tube 200, and such liquids may be mixed or blended together by flowing through the mixing wheel 202. Additionally, when only one of the valves is opened, a single liquid may flow through the mixing wheel 202 and still provide an unblended single liquid to the dispensing assembly 132. In FIG. 7, the liquid(s) may flow through the plurality of chambers (e.g., three chambers) in a direction out of the page, e.g., normal to the view plane of FIG. 7, whereupon the liquid(s) encounter a plurality of mixing vanes 216 of the mixing wheel 202, e.g., which may be arranged in a circumferential array around the mixing wheel 200 and may be configured, e.g., shaped and oriented, to rotate in a direction 218 under the force, e.g., pressure, of the liquid(s) flowing through the mixing wheel 202. The rotation of the mixing vanes 216 thereby imparts a swirl, e.g., spiral or vortex, motion to the liquid(s) flowing through the mixing wheel 202, such that when two or more liquids flow through the mixing wheel 202 the resulting turbulent flow causes the liquids to be mixed or blended together.

As mentioned above, a plurality of valves may be provided between each liquid source and the multi-fluid tube 200. Various exemplary embodiments of the multi-fluid dispensing system including such valves are illustrated in FIGS. 8 through 11.

Figure 8:
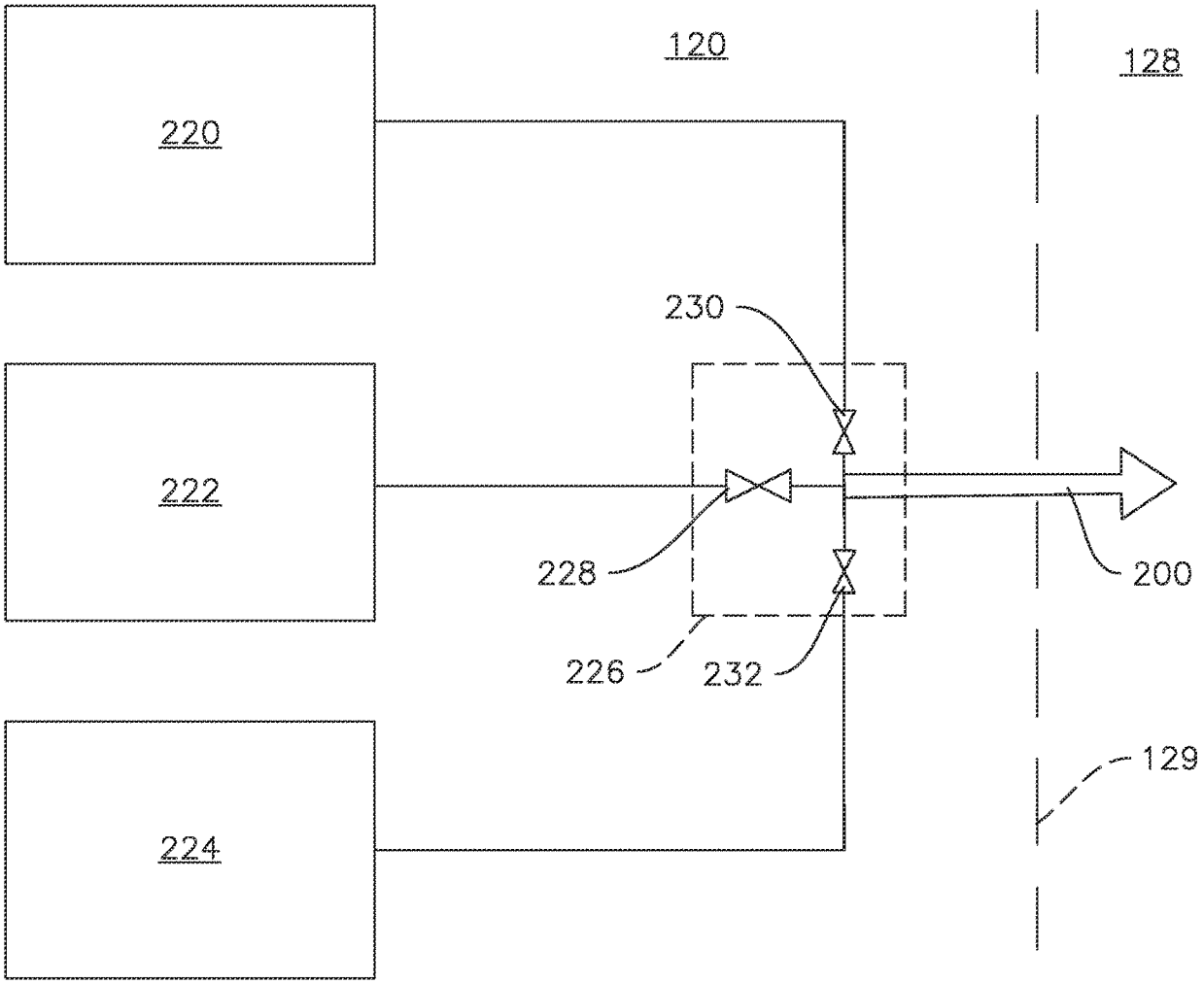
FIG. 8 provides a schematic illustration of a multi-fluid dispenser system for a refrigerator appliance according to one or more embodiments of the present subject matter.

In some embodiments, e.g., as illustrated in FIG. 8, the multi-fluid dispensing system may include a plurality of distinct liquid sources, such as a plurality of tanks or reservoirs where each tank may hold a distinct liquid which is separately and independently stored from the liquid in each other tank. For example, in the embodiment illustrated in FIG. 8, the multi-fluid dispensing system includes a first tank 220, a second tank 222, and a third tank 224, and each tank 220, 222, and 224 comprises a distinct liquid source, e.g., each tank contains a different liquid from that contained in every other tank. As mentioned above, the liquids may be one or more juices, tea, flavored water, etc.

Also as may be seen, e.g., in FIG. 8, the system may include a valve assembly 226. The valve assembly 226 generally includes a plurality of valves corresponding to the plurality of liquid sources, such as one valve for each liquid source and one liquid source coupled to each valve. For example, in embodiments such as the exemplary embodiment illustrated in FIG. 8, the plurality of liquid sources may include three liquid sources, e.g., three tanks 220, 222, and 224, and the valve assembly 226 may include three valves, with each valve coupled to a respective one of the tanks. In particular, as illustrated in FIG. 8, the valve assembly 226 may include a first valve 230 coupled between the first tank 220 and the multi-fluid tube 200, a second valve 228 coupled between the second tank 222 and the multi-fluid tube 200, and a third valve 232 coupled between the third tank 224 and the multi-fluid tube 200. Thus, in operation, opening the first valve 230 permits the first liquid from the first tank 220 to flow to the multi-fluid tube (and from the multi-fluid tube 200 to the dispensing assembly 132), opening the second valve 228 permits the second liquid from the second tank 222 to flow to the multi-fluid tube 200, etc. In some instances, opening more than one, up to and including all, e.g., all three, of the valves may permit multiple distinct liquids to flow into and through the multi-fluid tube 200, mix within and by the mixing wheel 202 (FIGS. 5 and 7) and thereby provide a mixture of liquids, such as mixed juices or a mixture of juice and carbonated water, etc., to the dispensing assembly 132. Additionally, in some embodiments, the opening time of each valve 228, 230, and 232 may be different to provide a different mixing ratio. For example, the first valve 230 may be opened twice as long as one or both of the second valve 228 and the third valve 232 to provide a mixing ratio of 2:1 or 2:1:1 of the first liquid to the second liquid and/or third liquid, or the second valve 228 may be opened 50% longer than one or both of the first valve 230 and the third valve 232 to provide a mixing ratio of 1.5:1 or 1.5:1:1 of the second liquid to the first liquid and/or third liquid, etc., in various combinations.

As schematically illustrated in FIG. 8, the refrigerator appliance 100 may include a cabinet 120 and a door 128, with the door 128 mounted, e.g., rotatably mounted, to the cabinet 120 by a hinge 129. In various embodiments, the multi-fluid tube 200 may pass through the hinge 129, such as the only fluid conduit passing through the hinge 129 to the dispensing assembly 132, as described above. Thus, the plurality of liquid sources, such as the three tanks 220, 222, and 224 illustrated in FIG. 8, may be located in the cabinet 120 and may be in fluid communication with the dispensing assembly 132 on the outer surface of the door 128 through the hinge 129 via the multi-fluid tube 200. Thus, the plurality of liquid sources may be in fluid communication with the dispensing assembly 132 through and by a single shared or common conduit, e.g., the multi-fluid tube 200. Providing a common or shared conduit for the plurality of liquid sources may advantageously permit multiple distinct liquids, including mixtures thereof, to be provided to the dispensing assembly 132 on the exterior of the refrigerator appliance 100, e.g., on the outer surface of the door 128, without increasing the number of fluid conduits extending through the hinge 129. In some embodiments, e.g., as illustrated in FIG. 8, the valve assembly 226 may be positioned within the cabinet 120.

Figure 9:
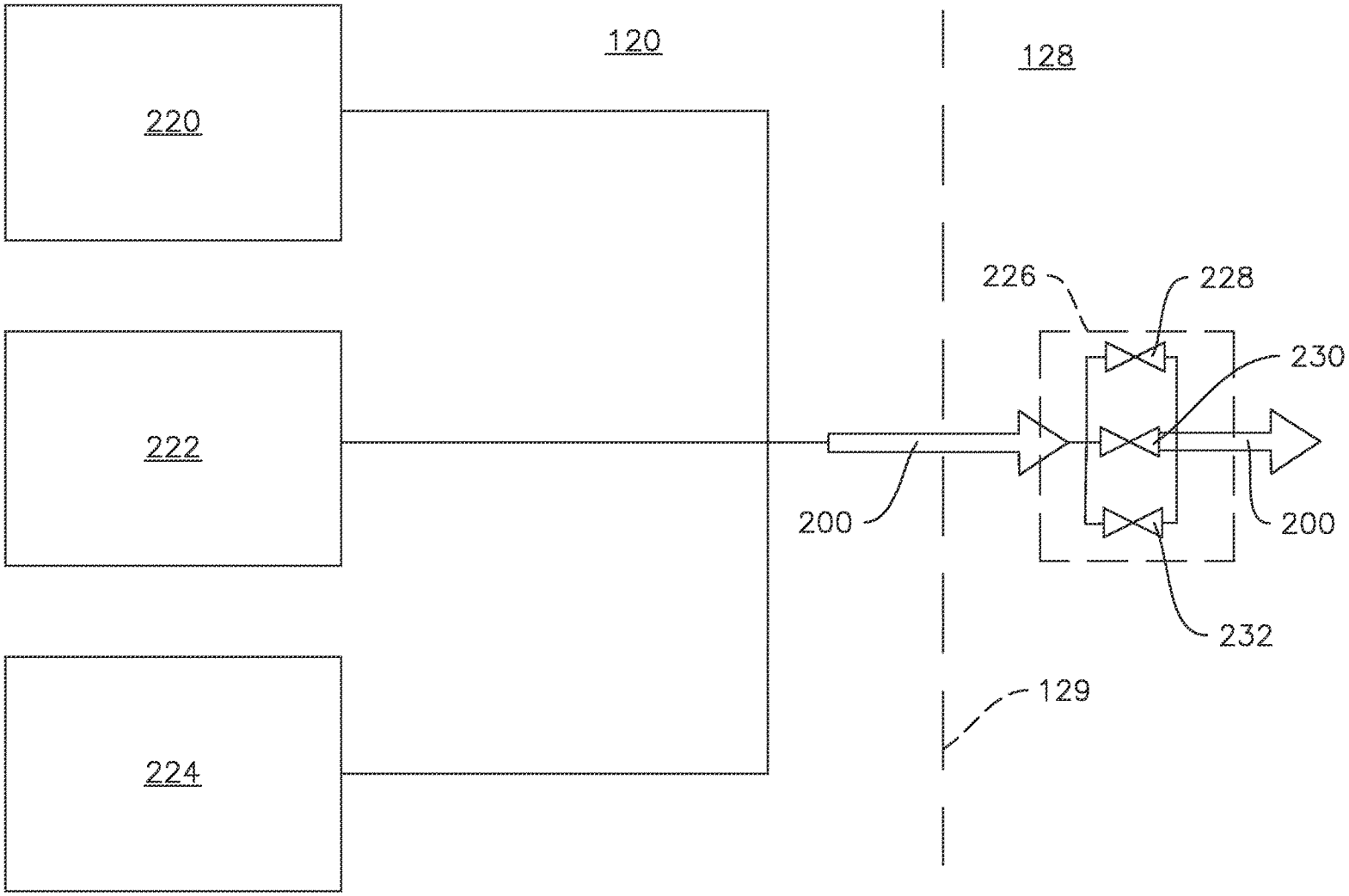
FIG. 9 provides a schematic illustration of a multi-fluid dispenser system for a refrigerator appliance according to one or more additional embodiments of the present subject matter.

Another exemplary embodiment wherein the plurality of liquid sources comprises three separate and distinct tanks 220, 222, and 224 is illustrated in FIG. 9. In some embodiments, e.g., as illustrated in FIG. 9, the tanks 220, 222, and 224 may be located in the cabinet 120 while the valve assembly 226 is located within the door 128. In such embodiments, e.g., as illustrated in FIG. 9, the valve assembly 226 may be coupled to the tanks 220, 222, and 224 via a first multi-fluid tube 200 upstream of the valve assembly 226, and the valve assembly 226 may be coupled to the dispensing assembly 132 via a second multi-fluid tube 200 downstream of the valve assembly 226. In such embodiments, the second multi-fluid tube 200 downstream of the valve assembly 226 may include the mixing wheel 202, while the first multi-fluid tube 200 upstream of the valve assembly 226 may omit the mixing wheel 202.

When the valve assembly 226 is provided within the door 128, e.g., as illustrated in FIG. 9, the first tank 220 may be coupled to and in direct fluid communication with the first chamber 208 (FIG. 6) of the first multi-fluid tube 200, the second tank 222 may be coupled to and in direct fluid communication with the second chamber 210 (FIG. 6) of the first multi-fluid tube 200, and the third tank 224 may be coupled to and in direct fluid communication with the third chamber 212 (FIG. 6) of the first multi-fluid tube 200. In particular, the first tank 220 may be connected to an upstream end of the first chamber 208 of the first multi-fluid tube 200 while the first valve 230 may be connected to a downstream end of the first chamber 208 of the first multi-fluid tube 200, the second tank 222 may be connected to an upstream end of the second chamber 210 of the first multi-fluid tube 200 while the second valve 228 may be connected to a downstream end of the second chamber 210 of the first multi-fluid tube 200, and the third tank 224 may be connected to an upstream end of the third chamber 212 of the first multi-fluid tube 200 while the third valve 232 may be connected to a downstream end of the third chamber 212 of the first multi-fluid tube 200. Thus, in a similar manner as described above with respect to FIG. 8, opening one or more of the valves 230, 228, and/or 232 provides a flow of liquid(s) from the respective tank(s).

In embodiments such as the example illustrated in FIG. 9, the flow of liquid(s) are then provided from the valve assembly 226 to the second multi-fluid tube 200. In particular, the first valve 230 may be connected to an upstream end of the first chamber 208 of the second multi-fluid tube 200, the second valve 228 may be connected to an upstream end of the second chamber 210 of the second multi-fluid tube 200, and the third valve 233 may be connected to an upstream end of the third chamber 212 of the second multi-fluid tube 200. The dispensing assembly 132 may be coupled to the downstream end of the second multi-fluid tube 200, e.g., downstream of each of the chambers 208, 210, and 212 thereof, whereby the dispensing assembly 132 receives a flow of one or more liquids, such as a mixture of liquids via the mixing wheel 202, directly from one or more of the chambers 208, 210, and/or 212 of the second multi-fluid tube 200.

Figure 10:
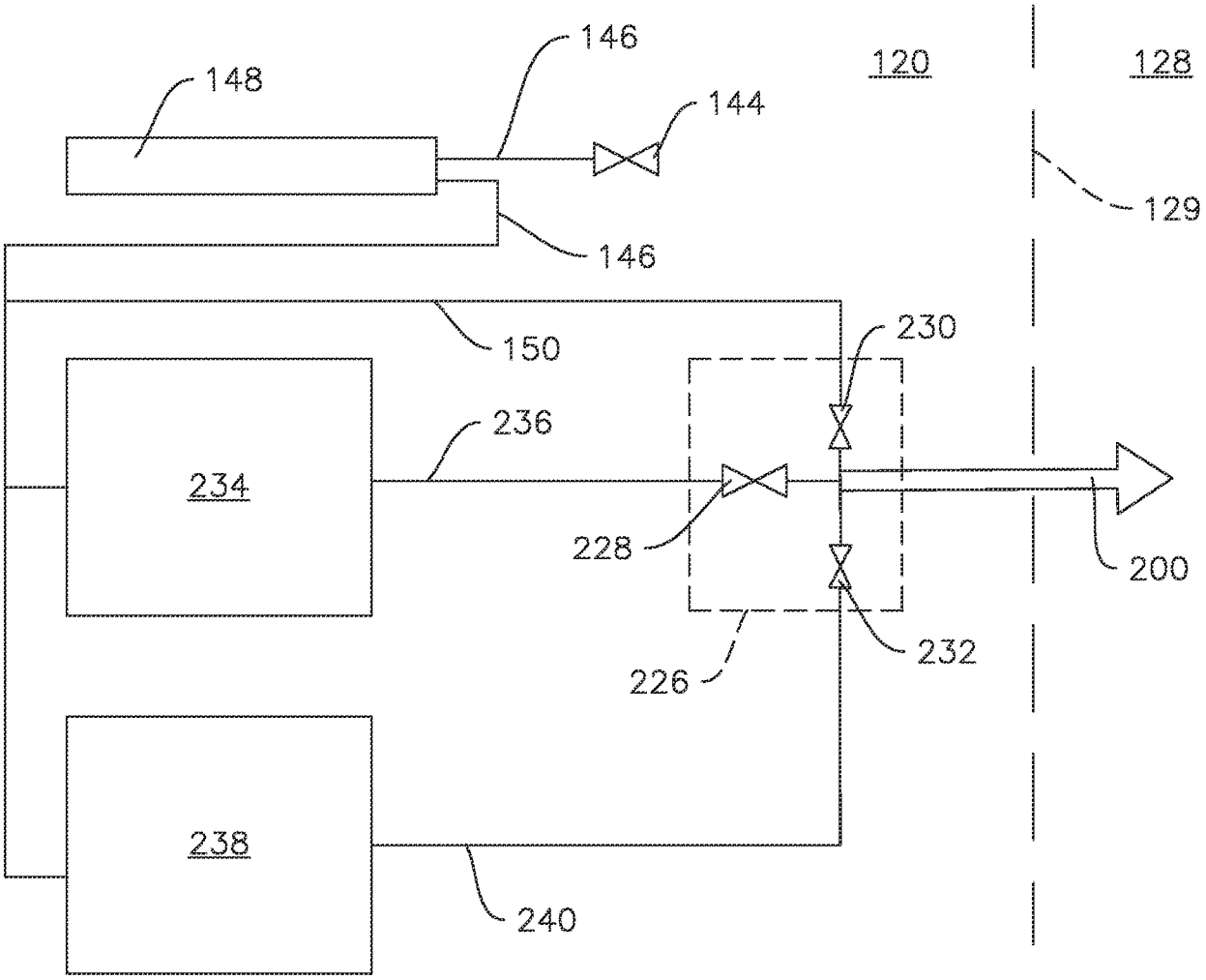
FIG. 10 provides a schematic illustration of a multi-fluid dispenser system for a refrigerator appliance according to one or more additional embodiments of the present subject matter.

In some embodiments, e.g., as illustrated in FIG. 10, the plurality of liquid sources may be a plurality of water sources each providing water at a distinct temperature from that of every other water source. For example, the refrigerator appliance 100 may be connected to a water supply, such as a well or a municipal water system, etc., via a plumbing system in a building as is generally understood by those of ordinary skill in the art. The refrigerator appliance 100 may include a supply valve 144 by which the refrigerator appliance 100 is connected to the water supply. Downstream of the supply valve 144 may be a supply line or inlet line 146 and, optionally, a water filter 148. The plurality of water sources may be downstream of the water filter 148 to receive filtered water therefrom.

The plurality of water sources may include a room temperature water source such as a room temperature line 150 which extends directly from the water filter 148 and/or the inlet line 146 to provide water at an as-received temperature, such as an ambient or room temperature, to the valve assembly 226, such as to the first valve 230 as illustrated in FIG. 10. The first valve 230 may then be connected to an upstream end of the multi-fluid tube 200, such as to the first chamber 208 of the multi-fluid tube 200 at the upstream end of the multi-fluid tube 200.

The plurality of water sources may also include a chilled water source 234. For example, in some embodiments, the chilled water source 234 may include a tank or reservoir which holds water from the water filter 148 and/or the inlet line 146 within the cabinet 120, such as in one of the chilled chambers thereof, in order to cool the water, such as to at or about the temperature of the chilled chamber in which the chilled water tank 234 is located. In other embodiments, the chilled water source, e.g., chilled water tank 234, may be located in the door 128, such as at or near an inner surface of the door 128 to expose water in the chilled water tank 234 to reduced (e.g., below ambient or room temperature) temperatures within the chilled chamber of the refrigerator appliance 100, thereby chilling the water in the chilled water tank 234. The chilled water source 234 may be coupled to the valve assembly 226, such as the second valve 228 thereof, to provide chilled water to the multi-fluid tube 200, such as to the second chamber 210 of the multi-fluid tube 200. The chilled water source 234 may be coupled to the valve assembly 226 via a chilled water line 236. The chilled water line 236 may be coupled between the chilled water tank 234 and the second valve 228, downstream of the chilled water tank 234 and upstream of the second valve 228. The second valve 228 may be downstream of the chilled water tank 234 (and the line 236) and upstream of the multi-fluid tube 200, in particular the second chamber 210 thereof.

The plurality of water sources may also include a warm water source, such as the warm water tank 238 illustrated schematically in FIG. 10. As mentioned above in the context of FIG. 4, the refrigerator appliance 100 may include a heat exchanger, in particular a condenser 66, where thermal energy (heat) from a refrigerant is transferred to the exterior of the condenser 66. In such embodiments, the warm water tank 238 may be positioned in the mechanical compartment 62, adjacent or proximate to and/or in thermal communication with the condenser 66 in order to provide heat to water from the water filter 148 and/or the inlet line 146 that is stored in the warm water tank 238. The warm water tank 238 may be connected to the multi-fluid tube 200, e.g., the third chamber 212 thereof, by and through the third valve 232. The warm water source 238 may be coupled to the valve assembly 226 via a warm water line 240.

Figure 11:
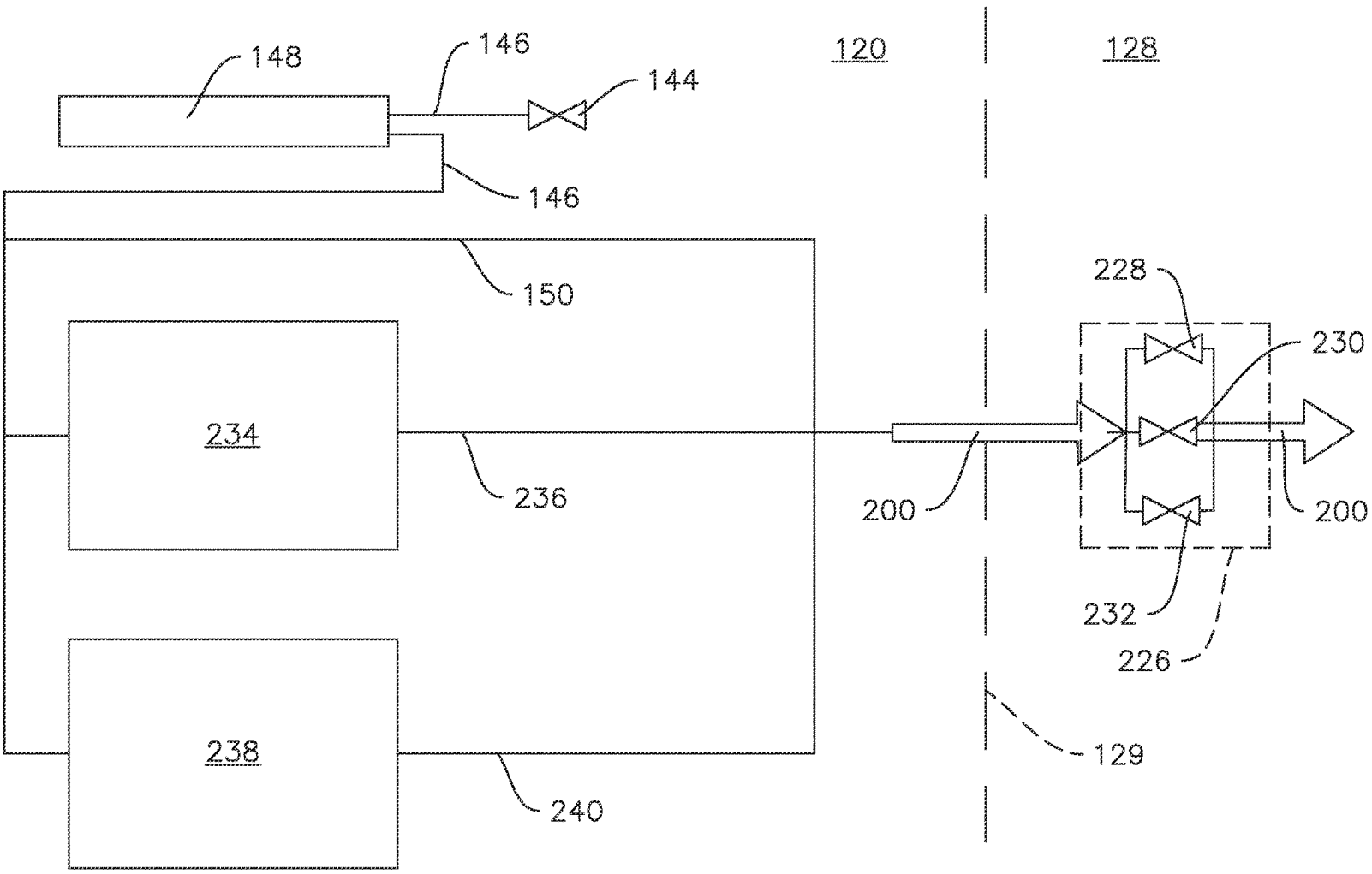
FIG. 11 provides a schematic illustration of a multi-fluid dispenser system for a refrigerator appliance according to one or more additional embodiments of the present subject matter.

In additional embodiments, as illustrated in FIG. 11, the valve assembly 226 may be positioned in the door 128 and may be in fluid communication with the plurality of water sources, e.g., the room temperature water line 150, the chilled water tank 234, and the warm water tank 238, by a first multi-fluid tube 200 and may be in fluid communication with the dispensing assembly 132 via a second multi-fluid tube 200, in a similar manner as described above with respect to FIG. 9, with the exception that the upstream end of the first multi-fluid tube 200 is connected to the water sources 150, 234, and 238, as described above with respect to FIG. 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet;

a food storage chamber defined in the cabinet, the food storage chamber extending between a front portion and a back portion along the transverse direction, the front portion of the food storage chamber defining an opening for receipt of food items;

a door rotatably mounted to the cabinet at the front portion of the food storage chamber, the door rotatably mounted to the cabinet by a hinge, the door movable between a closed position and an open position to selectively sealingly enclose the food storage chamber, the door comprising an outer surface and an opposing inner surface, wherein the inner surface faces towards the food storage chamber when the door is in the closed position and the outer surface faces away from the food storage chamber when the door is in the closed position;

a dispenser assembly formed in the outer surface of the door;

a plurality of liquid sources fluidly coupled to the dispenser assembly, each liquid source of the plurality of liquid sources located within the cabinet; and a multi-fluid tube, wherein each liquid source of the plurality of liquid sources is fluidly coupled to the dispenser assembly through the multi-fluid tube and the multi-fluid tube extends between the plurality of liquid sources and the dispenser assembly through the hinge from within the cabinet;

wherein the multi-fluid tube comprises a single conduit with a plurality of distinct chambers defined therein.

2. The refrigerator appliance of claim 1, wherein the plurality of liquid sources comprises a plurality of water sources, each water source of the plurality of water sources providing water at a distinct temperature from every other water source.

3. The refrigerator appliance of claim 2, wherein the plurality of water sources comprises a room temperature water source, a chilled water source, and a warm water source.

4. The refrigerator appliance of claim 3, wherein the warm water source is located adjacent to a condenser of a sealed cooling system of the refrigerator appliance.

5. The refrigerator appliance of claim 1, further comprising a plurality of valves, each valve of the plurality of valves fluidly coupled to a respective one liquid source of the plurality of liquid sources.

6. The refrigerator appliance of claim 5, wherein the plurality of valves are located in the door.

7. The refrigerator appliance of claim 5, wherein the plurality of valves are located in the cabinet.

8. The refrigerator appliance of claim 1, wherein the plurality of liquid sources comprises a plurality of distinct liquid sources.

9. The refrigerator appliance of claim 1, further comprising a mixing wheel in the multi-fluid tube.

10. The refrigerator appliance of claim 1, further comprising a partition disposed within the multi-fluid tube, the partition dividing an interior of the multi-fluid tube into a plurality of cavities, each cavity of the plurality of cavities in the multi-fluid tube fluidly coupled to a single one liquid source of the plurality of liquid sources.

11. A refrigerator appliance, comprising:

a cabinet;

a food storage chamber defined in the cabinet, the food storage chamber defining an opening for receipt of food items;

a door rotatably mounted to the cabinet at the opening of the food storage chamber, the door rotatably mounted to the cabinet by a hinge, the door movable between a closed position and an open position to selectively sealingly enclose the food storage chamber, the door comprising an outer surface and an opposing inner surface, wherein the inner surface faces towards the food storage chamber when the door is in the closed position and the outer surface faces away from the food storage chamber when the door is in the closed position;

a dispenser assembly formed in the outer surface of the door;

a plurality of liquid sources fluidly coupled to the dispenser assembly, each liquid source of the plurality of liquid sources located within the cabinet; and a multi-fluid tube, wherein each liquid source of the plurality of liquid sources is fluidly coupled to the dispenser assembly through the multi-fluid tube and the multi-fluid tube extends between the plurality of liquid sources and the dispenser assembly through the hinge from within the cabinet;

wherein the multi-fluid tube comprises a single conduit with a plurality of distinct chambers defined therein.

12. The refrigerator appliance of claim 11, wherein the plurality of liquid sources comprises a plurality of water sources, the plurality of water sources comprising a room temperature water source, a chilled water source, and a warm water source.

13. The refrigerator appliance of claim 11, further comprising a plurality of valves, each valve of the plurality of valves fluidly coupled to a respective one liquid source of the plurality of liquid sources.

14. The refrigerator appliance of claim 13, wherein the plurality of valves are located in the door.

15. The refrigerator appliance of claim 13, wherein the plurality of valves are located in the cabinet.

16. The refrigerator appliance of claim 11, wherein the plurality of liquid sources comprises a plurality of distinct liquid sources.

* * * * *